United States Patent [19]

Ching

[11] Patent Number: 4,491,291

[45] Date of Patent: Jan. 1, 1985

[54] CLIMBING AID FOR MOUNTAIN CLIMBERS

[76] Inventor: Paul W. Ching, 3153 W. Echo La., Phoenix, Ariz. 85021

[21] Appl. No.: 344,619

[22] Filed: Feb. 1, 1982

[51] Int. Cl.[3] ..... F16M 13/00

[52] U.S. Cl. ..... 248/1

[58] Field of Search ..... 248/1, 205 B; 411/340, 411/341, 342, 343, 344, 345, 346

[56] References Cited

U.S. PATENT DOCUMENTS

| | | | |
|---|---|---|---|
| 1,242,569 | 10/1917 | McDonald | 411/344 |
| 3,877,679 | 4/1975 | Lowe | 248/1 |
| 3,903,785 | 9/1975 | Pepper | 411/80 |
| 4,184,657 | 1/1980 | Jardine | 248/1 |

FOREIGN PATENT DOCUMENTS

| | | | |
|---|---|---|---|
| 1305222 | 4/1962 | France | 411/340 |

*Primary Examiner*—William H. Schultz

*Attorney, Agent, or Firm*—Cahill, Sutton & Thomas

[57] ABSTRACT

A pair of opposed laterally extendable chocks of a climbing aid frictionally engage facing surfaces of a crevice to preclude withdrawal from the crevice of a supported load bearing member. A release located on the load bearing member on actuation retracts the chocks to accommodate withdrawal of the climbing aid from within the crevice.

8 Claims, 4 Drawing Figures

FIG. 1
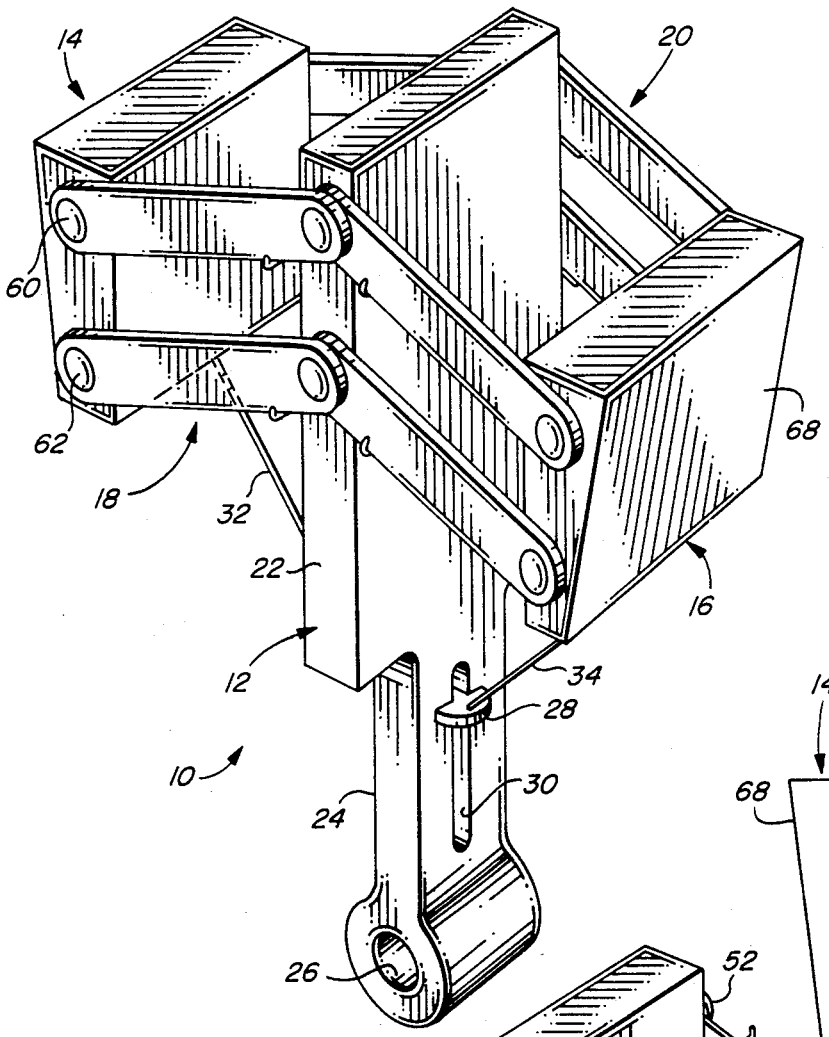
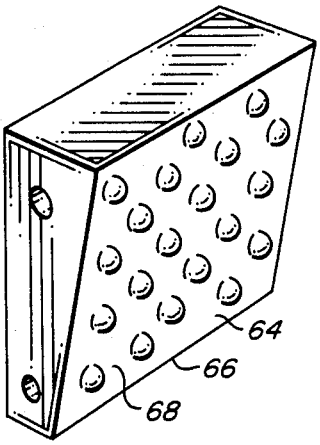
FIG. 4
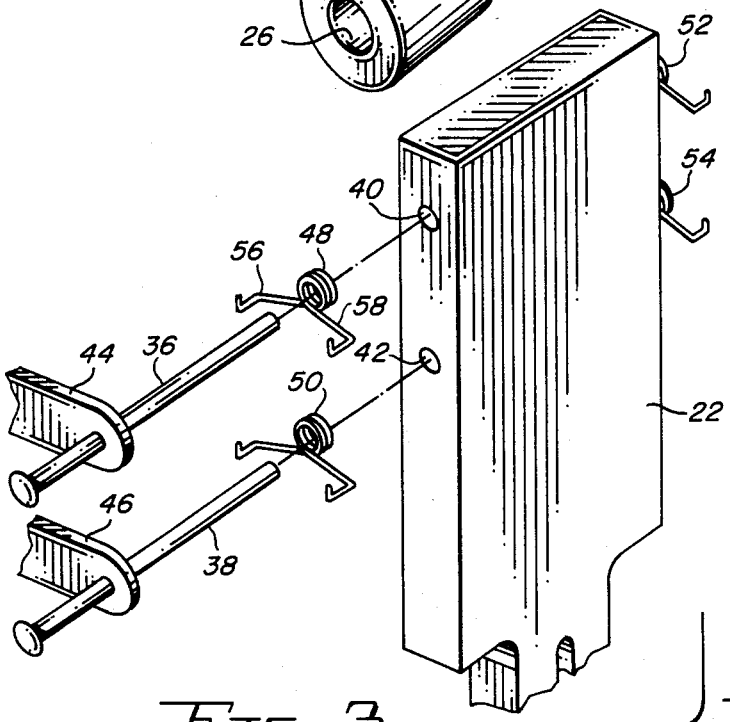
FIG. 3
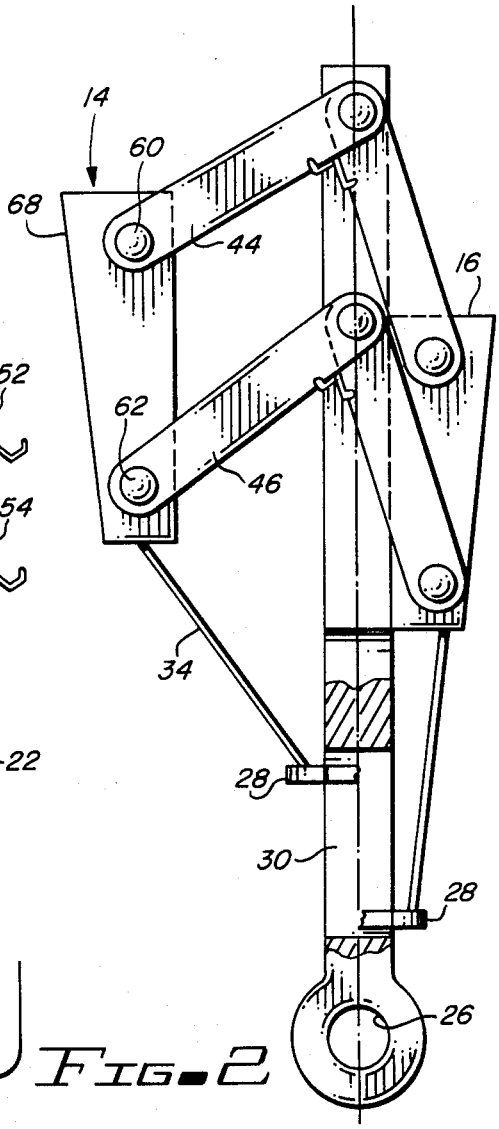
FIG. 2

CLIMBING AID FOR MOUNTAIN CLIMBERS

The present invention relates to climbing aids for mountain climbers and, more particularly, to climbing aids which lockingly engage crevices.

Mountain climbers may use a number of mechanical climbing aids to establish points of support from rock walls or overhangs. Pitons have been used for this purpose for centuries. Presently available pitons are manufactured of chrome molybdenum steel and heat treated for high strength and uniform toughness. The configuration of the pitons may vary but each generally includes a spike-like segment terminated at the blunt end with an aperture for receiving a rope or the like. Various wedges, a form of piton, have also been developed which wedges may be irregular hexagonal, trapezoidal, T-shaped or cam shaped in cross-section such that the effective width thereof expands upon application of a pulling force thereon. These climbing aids, or pitons, may be termed passive climbing aids as no elements thereof are repositioned with respect to any other elements during insertion, locking or removal.

A device manufactured by Jardine Enterprises and sold under the trademark "FRIENDS" may be termed an active climbing aid. It includes a plurality of pivotally mounted cams for accommodating a range in width of crevices which may be lockingly engaged. In operation, the cams rotate so as to provide the greatest possible effective width on application of a pulling force upon a cam supporting member to establish frictional engagement of the cams with the opposed engaged surfaces in proportion to the pulling force. Withdrawal of the device is effected by rotating the cams in the opposite direction to decrease the effective width presented.

Various U.S. Patents have issued which are directed to moveable elements for varying the effective width of a device in response to a force applied thereto U.S. Pat. No. 3,903,785 is directed to an anchor for rock climbers. The anchor includes a wedge coacting with two outer parts in response to a force applied to the wedge by an attached cable; the resulting movement of the wedge increases the effective width of the outer parts to bring about locking engagement with opposed contacted surfaces of a crack in a rock. U.S. Pat. No. 761,277 illustrates a guy wire anchor having radially expandable flukes actuated by a lead screw mechanism. U.S. Pat. No. 1,224,698 is directed to coil spring loaded pivotally expandable wings mounted upon a threaded rod. The device is used primarily for establishing an anchor point through a wall or similar membrane-like element.

The climbing aid described herein includes a pair of opposed laterally expandable chocks pivotally connected by a parallelogram linkage to a load bearing member for frictionally engaging opposed surfaces of a narrow confine, such as a crevice in a rock wall. The parallelogram linkage supports each chock independently of the other to maintain the orientation of the chock with respect to the load bearing member in a position to maximize the area contacted. Release of the climbing aid is effected by manually pivoting the parallelogram linkage to a lesser angle to effect disengagement of the chocks with the contacted surfaces.

It is therefore a primary object of the present invention to provide a chock laterally extendable from a load bearing member to maintain the load bearing member lodged within a crevice or other narrow confine.

Another object of the present invention is to provide a load bearing member frictionally lockable within a narrow confine with a locking force proportional to the load imposed.

Yet another object of the present invention is to provide a pair of opposed chocks laterally extendable from a load bearing member to maintain the supported load bearing member within a narrow confine.

Yet another object of the present invention is to provide an automatically laterally expandable climbing aid for establishing an anchor within a narrow confine.

A further object of the present invention is to provide a climbing aid for establishing an anchor within a range of crevice widths.

A yet further object of the present invention is to provide a climbing aid for mountain climbers which will not have a tendency to damage crevices and the like within which it may be placed.

A still further object of the present invention is to provide a sturdy and simple to operate climbing aid for establishing an anchor within a crevice.

These and other objects of the present invention will become apparent to those skilled in the art as the description thereof proceeds.

The present invention may be described with greater specificity and clarity with reference to the drawings, in which:

FIG. 1 is a perspective view of the climbing aid in the fully extended position;

FIG. 2 illustrates the position of the chocks in the radially expanded state and radially contracted state;

FIG. 3 is an isometric illustration of a portion of the load bearing member; and FIG. 4 illustrates a variant of the chocks.

Referring to FIG. 1, there is shown a climbing aid 10 having a load bearing member 12 supporting a pair of opposed chocks 14 and 16 through parallelogram linkages 18 and 20, respectively. The load bearing member includes a body member 22, a neck 24 extending therefrom and terminated by an eyelet 26. The latter is an engaging means configured to receive and retain a rope or other element to be connected to and supported from the climbing aid. A rod or bar 28 is located within a slot 30 disposed in neck 24. The bar interconnects with chocks 14 and 16 through cables 32 and 34, respectively, to limit or control the lateral displacement of the chocks.

Referring jointly to FIGS. 1, 2 and 3, the operation of the chocks and the structure attendant thereto will be described. Pins 36, 38 extend through cavities 40, 42 disposed within body member 22 to pivotally support the links of the parallelogram linkages, of which links 44 and 46 are illustrated in FIG. 3. Bias means, such as coil springs 48, 50, 52 and 54 are supported upon the pins to bias the links of the parallelogram linkages. Each coil spring includes a pair of legs, such as legs 56, 58 extending from coil spring 48, for engaging the edge of the respective links. It is to be understood that pins 36, 38 may be substituted by individual pins associated with each attached link, bosses extending from the body member or similar support means. The link interconnecting pins attendant the chocks, such as pins 60, 62, may be like pins 36, 38 extending through chock 14 or may be variations thereof to provide a pivotal interconnection.

Under urging of the bias means, chocks 14 and 16 will tend to be pivotally repositioned laterally outwardly and upwardly with respect to body member 22. Limitation on the extent of pivotal movement is provided by limitation means such as cables 32, 34. Accordingly, these cables limit the effective width defined by chocks 14 and 16 at their most extended position. Such limitation may be modified or altered by either changing the length of the cables or by lengthening or shortening the effective length of slot 30 within which bar 28 is positionable.

The operation of climbing aid 10 will be described with primary reference to FIG. 2. Prior to insertion of the climbing aid within a crevice or like narrow confine wherein an anchor is to be established, bar 28 is drawn to its lower most position which results in downward and inward movement of the chocks, as illustrated by chock 16. This position represents the narrowest effective width of the climbing aid. Upon insertion of the climbing aid, bar 28 is released to allow it to be repositioned upwardly within slot 30 under urging of the bias means acting upon the links of the parallelogram linkages.

At the upper portion of bar 28, as illustrated in the left hand side of FIG. 2, chock 14 is extended laterally until it and corresponding chock 16, comes into contact with the opposing faces of the confine. After positioning of the climbing aid within the confine by engagement of the chocks with the surfaces thereof, a load may be applied to eyelet 26.

On application of such a load, the resulting forces acting through load bearing member will be translated through the links of the parallelogram linkages to urge the chocks to extend laterally against the contacted surface; it is presumed that lateral extension of the chocks is not inhibited by interference of bar 28 with the end of slot 30. The resulting translation of forces acting upon the chocks will cause them to impose forces against the contacted surfaces proportional to the load imposed upon the load bearing member commensurate with the angle defined between the links and the load bearing member and produce a commensurate increase in friction between the chocks and the contacted surfaces. Thus, the greater the load imposed, the greater is the strength of the locking action of the climbing aid within the confine.

To withdraw the climbing aid from within the confine, the imposed load must be removed from the load bearing member. Bar 28 is then manually repositioned within slot 30 toward eyelet 26 until the chocks become disengaged with the contacted surfaces. Such disengagement may be aided by slightly forcing the load bearing member further into the crevice which results in angular movement of the parallelogram linkages toward one another to laterally retract the chocks and effect disengagement.

The shape of chocks 14 and 16 may be altered to more effectively frictionally engage different surface configurations. In example, as illustrated in FIG. 4, the contacting surface 64 of chock 66 may be pebbled as shown. Alternatively, the truncated wedge shape may be altered in orientation or cross-section Moreover, the width and height of contacting surface 68 may be modified, provided due structural changes are made to support the chock from the attendant links.

It is to be understood that a single chock rather than a pair of opposed chocks may also be employed. In this configuration, the load member would serve the function of frictionally engaging one of the surfaces of the confine within which the climbing aid is positioned. To aid the load bearing member in frictionally engaging a surface of the confine, the relevant side of the load bearing member may be pebbled, grooved or otherwise modified to maximize frictional engagement.

In a yet further embodiment of climbing aid 10, the pair of chocks or one chock and the load bearing member may be modified in configuration to mechanically rather than frictionally engage supporting elements within or attendant a confine. An example might be insertion of the climbing aid through a necked segment of a confine for mechanical engagement with the laterally extended surfaces on the far side of the necked portion.

In a further variant of the climbing aid (not illustrated), the parallelogram linkages may be replaced by a single link or a pair of links pivotally interconnecting the load bearing member and the chock. With such a configuration, the chock would be free to pivot and align itself with the surface to be contacted. The maximum lateral extension would be limited by the cable interconnecting the chock with bar 28.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A climbing aid for establishing a removable anchor within a confine, said climbing aid comprising in combination:

(a) a body member;

(b) means for engaging said body member with an element to be supported therefrom;

(c) first and second chock means for contacting opposed surfaces of the confine;

(d) means for biasing said first and second chock means laterally and in opposed directions from said body member to establish frictional contact between said climbing aid and opposed surfaces of the confine;

(e) a first parallelogram linkage for linking said first chock means with said body member and a second parallelogram linkage for linking said second chock means with said body member to urge lateral displacement of said first and second chock means relative to said body member upon application of a force by the element upon said engaging means; and (f) means for displacing said first and second chock means laterally toward said body member to permit withdrawal of said climbing aid from within the confine.

2. The climbing aid as set forth in claim 1 wherein said first and second chock means comprise a pair of chocks for sandwiching said body member therebetween.

3. The climbing aid as set forth in claim 2 wherein said displacing means includes a movable bar.

4. The climbing aid as set forth in claim 3 wherein said displacing means further includes a cable extending from said bar to each chock of said pair of chocks for limiting the extent of pivotal movement of said pair of chocks.

5. The climbing aid as set forth in claim 4 wherein said body member includes a slot for limiting the extent of displacement of said bar.

6. The climbing aid as set forth in claim 5 wherein each chock of said pair of chocks is a truncated wedge shape in cross-section.

7. The climbing aid as set forth in claim 5 wherein each chock of said pair of chocks includes a non-planar surface for contacting the respective surface of the confine to increase the interference and frictional contact therebetween.

8. The climbing aid as set forth in claim 1 wherein said biasing means comprises coil springs acting upon the links of said first and second parallelogram linkages.

* * * * *